US005137471A

United States Patent [19]

Verespej et al.

[11] Patent Number: 5,137,471

[45] Date of Patent: Aug. 11, 1992

[54] MODULAR PLUG CONNECTOR AND METHOD OF ASSEMBLY

[75] Inventors: Michael A. Verespej; Henry R. Fredlund, both of Bridgewater, Conn.

[73] Assignee: Amphenol Corporation, Wallingford, Conn.

[21] Appl. No.: 549,085

[22] Filed: Jul. 6, 1990

[51] Int. Cl.[5] ..... H01R 17/04

[52] U.S. Cl. ..... 439/585; 439/322

[58] Field of Search ..... 439/578-585, 439/675, 312-321, 877, 879, 322

[56] References Cited

U.S. PATENT DOCUMENTS

| | | | |
|---|---|---|---|
| 2,995,718 | 8/1961 | Murphy | 439/320 |
| 3,320,575 | 5/1967 | Brown et al. | 439/584 |
| 3,701,086 | 10/1972 | Somerset | 439/585 |
| 3,754,206 | 8/1973 | Obeissart | 439/319 |
| 4,037,909 | 7/1977 | Trompeter et al. | 439/584 |
| 4,508,407 | 4/1985 | Ball | 339/89 R |
| 4,544,224 | 10/1985 | Goodman et al. | 439/321 |
| 4,596,434 | 6/1986 | Saba et al. | 339/177 R |
| 4,619,496 | 10/1986 | Forney et al. | 339/177 R |
| 4,687,279 | 8/1987 | Holland et al. | 439/578 |
| 4,688,876 | 8/1987 | Morelli | 439/578 |
| 4,688,878 | 8/1987 | Cohen et al. | 439/585 |
| 4,698,028 | 10/1987 | Caro et al. | 439/271 |
| 4,746,305 | 5/1988 | Nomura | 439/319 |
| 4,869,690 | 9/1989 | Frear et al. | 439/675 |

*Primary Examiner*—David Pirlot
*Attorney, Agent, or Firm*—Bacon & Thomas

[57] ABSTRACT

An improved plug connector includes a rear cable connection module individually sized to each cable required and a front outer contact portion arranged such that the modular rear cable connection component may be press fit into the outer contact portion. In order to assemble the connector, an insulated inner contact assembly is fitted into either the cable connection module or the outer contact front portion, and is retained and positioned therein when the outer contact front portion is press fit onto the cable connection module. In addition, a coupling nut is provided which may be snap fit onto the outer contact by means of a split ring and flat retaining washer assembly encapsulated in the coupling nut.

8 Claims, 2 Drawing Sheets

MODULAR PLUG CONNECTOR AND METHOD OF ASSEMBLY

BACKGROUND OF THE INVENTION

1. Field of the Invention

This invention relates to electrical connectors and more particularly to coaxial cable connectors.

2. Description of Related Art

The increasing demand for miniaturization and the decreased tolerances resulting from the requirements of modern data processing and communications equipment have greatly increased the cost of assembling electrical connectors used in such systems.

Due to the use of solid state components in computers and general information processing equipment, and therefore the need for low power level signals, man made noise interference has become a more serious problem than was the case when higher power levels were used in electronic equipment. Consequently, electronic devices require more shielding to preserve signal-to-noise ratios. In addition, because of the increasingly wider bandwidths and faster computation speeds of signal processing devices, the use of efficient coaxial cables capable of Megahertz performance has become increasingly necessary.

The coaxial cables used in high frequency communications and signal processing systems generally consist of a center conductor, an outer conductor circumferentially disposed around the center conductor, a cylindrical dielectric occupying the space between the center and the outer conductors, and an outer cylindrical jacket surrounding the outer conductor to provide electrical and environmental insulation. The outer conductor is usually woven out of fine metallic threads in the form of braid although, in a few specific cases, the outer conductor may be a solid metallic tube. Other common shielded cables include twin axial and triaxial cables, each of which generally utilizes a braided shield-type outer conductor.

FIG. 1 shows a shielded cable connector plug which is widely used to connect high frequency information signal carrying conductors. This type of connector is known as an "N"-type connector and includes a unitized body 2 and rear crimp ferrule 5 which is individually sized to the particular cable accommodated. The outer conductor of the coaxial cable is separated from the core dielectric and placed between a rear ferrule portion 3 on the unitized body 2, and crimped between a crimping ferrule 5 and the portion 3. Grooves 4 are provided in portion 3 to ensure good electrical contact and to hold the shield against axial stress.

The unitized body 2 includes a center bore in which is placed a cylindrical dielectric insulator member 6. Dielectric member 6 electrically insulates the outer body member 2 from an inner contact 7, which includes a bore 12 into which the center conductor of the coaxial cable is placed.

The outer conductor of the connector plug is mechanically bonded to the unitized body. Conventionally, this requires an expensively accurate staking operation, as indicated by reference numeral 13. It is essential that the cylindrical contact portion 10 of the outer contact be perfectly aligned with the center axis of inner contact 7, and thus great precision in assembly is required.

In addition to the staking operation, assembly of this type of connector requires provision of a coupling nut 8 and retaining ring 9 for securing the contact to a female jack type connector having external threads. In order to install the coupling nut and retaining ring, special dedicated assembly tooling is required, promoting labor intensive operations.

SUMMARY OF THE INVENTION

It is an objective of the invention to provide an improved plug connector including an outer contact assembly having a modular rear cable connection component individually sized to each cable required, and an outer contact geometry which permits either manual or automatic assembly.

It is a further objective of the invention to provide a plug connector having a pre-assembled coupling nut which includes an outer coupling housing which encapsulates a floating pre-stressed split ring and flat retaining washer assembly for the purpose of eliminating costly installation tooling and labor and therefore permitting addition of the coupling nut either manually or by automatic assembly equipment.

These objectives are achieved by providing a connector for a coaxial cable which includes an inner contact and an outer contact assembly, the outer contact assembly being formed in two discrete parts.

A first part of the outer contact assembly is a rear cable connection module which includes a cylindrical main body having a bevelled rear shoulder. The cable connection module also, in a preferred embodiment, includes an inner crimp ferrule extending rearwardly from the main body and an inner recess in the main body. The cable shield is crimped between an outer crimp ferrule and the rearwardly extending inner crimp ferrule, while the recess is used to retain a dielectric inner contact positioning and insulating member.

A second part of the outer contact assembly includes an outer contact member having contact tines extending from a cylindrical main body. The contact tines are shaped to mate with corresponding contacts on another connector. The outer contact member main body includes an inner recess having a rear diameter which is larger than a front diameter. The respective recesses in the two parts of the outer contact member cooperate to hold the dielectric member and precisely position the inner contact in respect to the outer contact.

The second part of the outer contact assembly has a diameter which is approximately equal to the outer diameter of the rear cable connection module main body, and is press fit into the outer contact assembly front portion to complete the outer contact assembly and retain the dielectric member therein. A roll formed retention portion at the rear of the outer contact main body cooperates with the bevelled portion on the main body of the crimp ferrule to additionally prevent the rear cable connection module from separating from the outer contact front portion.

Because of this arrangement, a variety of different rear cable connection modules may be installed into the same outer contact part, thereby permitting a variety of different cables to be used therewith.

The objectives of the invention are further achieved by providing a nut which includes a pre-assembled split ring and washer assembly. The split ring extends from a groove in the nut and has an inner diameter which is less than the outer diameter of the outer contact main body, and equal to the inner diameter of a circumferential groove in the main body.

Because the ring is split, it expands when fitted over the outer contact and snaps into place when it encounters the groove. Thus, the nut may be snapped onto the outer contact and the outer contact may be used with a variety of coupling nuts, or the coupling nut can be used with a variety of outer contacts.

DETAILED DESCRIPTION OF THE PREFERRED EMBODIMENT

Figure 2:
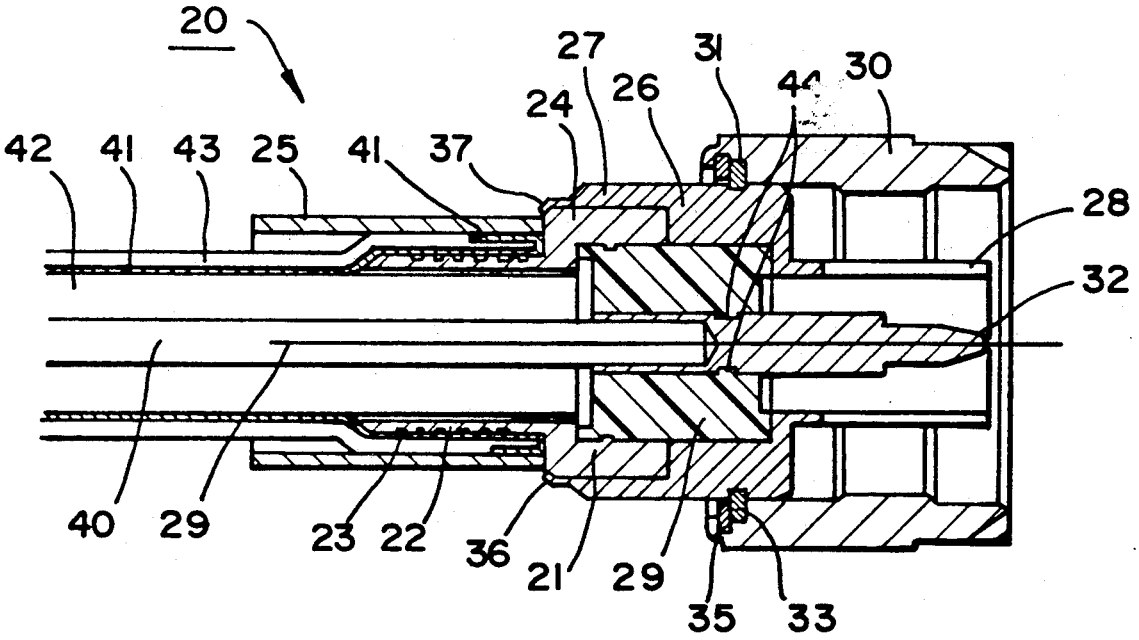
FIG. 2 is a cross sectional view of an improved coaxial cable crimp type connector according to a preferred embodiment of the invention including a unitized outer contact assembly and modular ferrule, and an improved coupling nut and snap ring assembly.

FIG. 2 is a cross sectional view of a connector plug according to a preferred embodiment of the invention. Each of the connector plug components has a generally cylindrical cross section having a common axis 29. Common cylinder axis 29 coincides with the central axis of a coaxial cable to be inserted into the connector.

The connector is designed to be used with a variety of diameters of coaxial cable. The coaxial cables for which the connector is intended are of the well-known type which includes a central conductor 40, an outer conductor 41 in the form of a metal braid, a core dielectric 42 between the center conductor 40 and the outer braid 41, and an outer jacket 43. The outer braid 41 may be replaced by a flexible foil or by a rigid outer shield.

In addition, the connector of the invention may be used with shielded cables other than coaxial cables, for example twinax or triax cables, by modifying the inner contact assembly to accommodate the various inner conductors carried by the cable.

Figure 1:
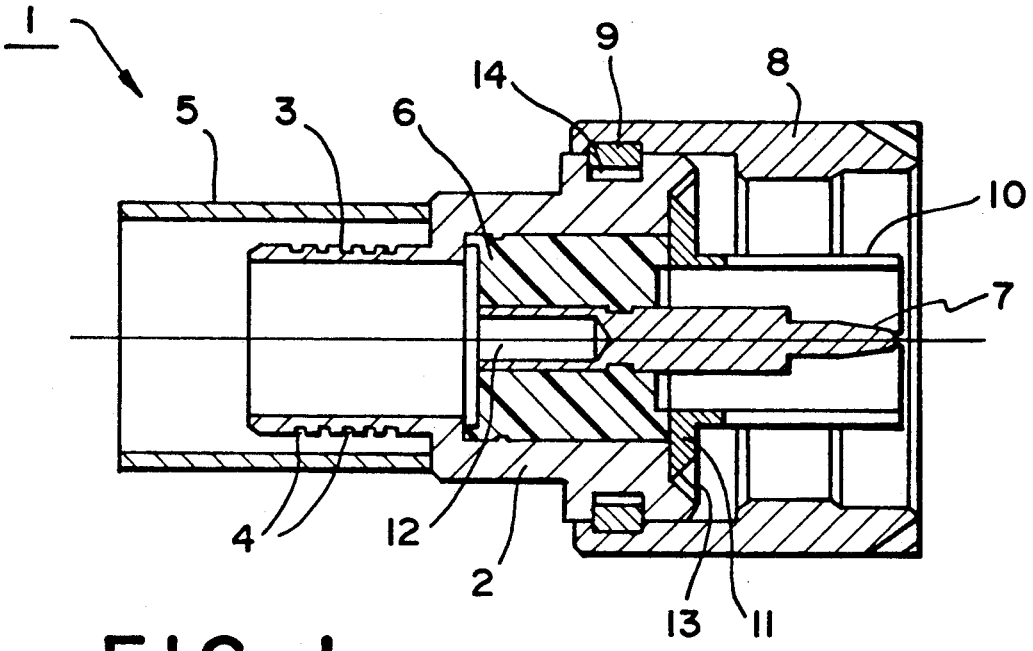
FIG. 1 (PRIOR ART)
FIG. 1 is a cross sectional view of a conventional coaxial cable crimp-type connector including a unitized and staked outer contact.

Except as noted below, the dimensions and materials of the conductor of the preferred embodiment are the same as those used in the corresponding prior art connector shown in FIG. 1. The inner contact 32 and coupling nut 48 must have outer and inner radii, respectively, which correspond to a standard corresponding coaxial female connector (not shown), and thus their dimensions are determined by external requirements. The inner diameter of the crimping ferrule and outer diameter of the inner body, to be described below, are likewise determined by the dimensions of the coaxial cable for which the connector is to be used.

Figure 3:
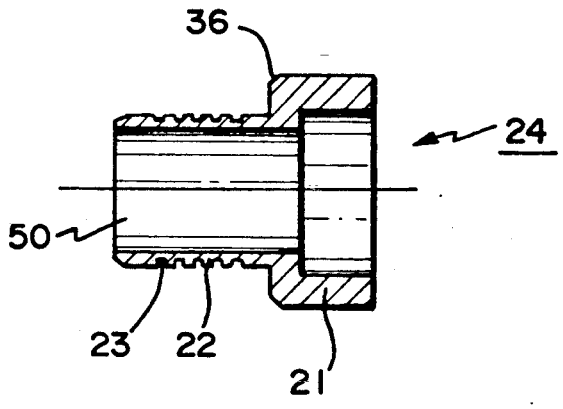
FIG. 3 is a cross sectional view of a rear cable connection module for use in the connector of the preferred embodiment.

The connector of the invention, generally designated by the reference numeral 20, includes a rear cable connection module 24, best shown in FIG. 3, which includes a main body 21 and a cable retention section 22 extending rearwardly from main body 21. Main body 21 includes a bevelled rear portion 36 for engagement with a cable connection module retention portion 37 on the outer contact member 28, to be described below.

Cable retention section 22 is provided with grooves 23 for increasing retention force on the cable shield 41 after crimping and to take up axial stresses on the cable shield. As shown in FIG. 2, the cable shield and outer jacket of the cable are placed between ferrule module 24 and an outer ferrule 25. The outer ferrule 25 is then crimped by a standard crimping tool which ensures uniform engagement and a good electrical connection between cable retention section 22 and cable shield 41.

In addition, cable retention section 22 is provided with a recess 50 in communication with a recess 49 in main body 21. Recess 50 serves to hold dielectric core 42 of the cable, as shown in FIG. 2. Both the outer diameter of section 22 and the inner diameter of main body 21 which defines the recess may be varied to fit the dimensions of a desired cable.

A dielectric insulating member 29 serves to electrically insulate the inner contact 32 from outer contact 47 and to align the inner contact in respect to outer contact assembly front member 28. Dielectric member 29 has an outer diameter equal to the inner diameter of cylindrical recess 50 in ferrule module 24 and to cylindrical recess 27 in outer contact 47, as will be explained below, and thus serves as a positioning member for the inner contact 32 in relation to outer contact portion 28. This positioning is obtained without the need for any sort of staking operation and, as a result, the respective contacts are self-aligning.

An inner bore 51 in dielectric member 29 has a diameter equal to the outer diameter of inner contact 32, which is inserted into the dielectric member such that when the dielectric member is fitted within the outer contact, the inner contact is both precisely positioned in respect to the outer contact and securely retained therein. The inner bore 51 may also include means, for example projections 44, for axially securing the inner contact within member 29.

Outer contact member 28 includes a main body portion 56 and recess 27 having a diameter equal to the outer diameter of main body 21 of cable connection module 24. In order to electrically connect a cable with outer contact member 28, body 21 is press fit into recess 27.

Main body 56 of outer contact member 28 is also provided with a retaining portion 37 for axially retaining the main body 21 of the rear cable connection module. Retaining portion 37 may include a plurality of roll formed inwardly directed tines for engaging a bevelled shoulder portion 36 on module 24 to latch module 24 and the outer contact member 28 together while permitting easy disengagement and engagement.

As a result, a single outer contact member 28 can be used with a variety of different rear cable connection modules 24 sized for different cables and, conversely, a single rear cable connection module may be used with a variety of different outer contact geometries. In the example shown, the outer contact member 28 includes a plurality of resilient tines 47 of known type for engagement with corresponding contacts on another connector having a female inner contact. However, numerous other contact tine configurations will occur to those skilled in the art, and it is intended that the scope of the invention include all such variations.

Outer contact member 28 also includes a second recess 27, formed in main body portion 56. Recess 27 is axially adjacent recess 26 and has a diameter which is smaller than that of recess 26, forming a step, and equal to that of recess 49. As a result, when module 24 is inserted into recess 26 of outer contact member 28, a chamber comprising recesses 27 and 49 is formed for retaining insulation member 29 and thereby positioning the outer contact member 28 in respect to inner contact 32.

Thus, accurate positioning of the inner and outer contacts is accomplished by simply press fitting the rear module 24 into outer contact member 28 after inserting dielectric member 29 to create the outer contact assembly, thus enabling either manual or automatic assembly while offering the advantages of modularity.

Figure 4:
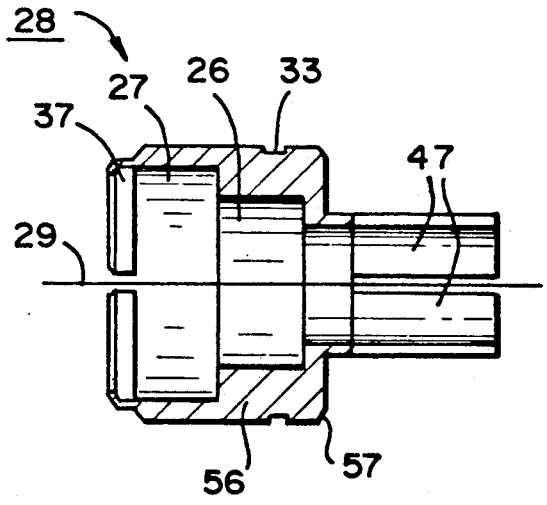
FIG. 4 is a cross sectional view of an outer contact member for use in the connector of the preferred embodiment.
Figure 5:
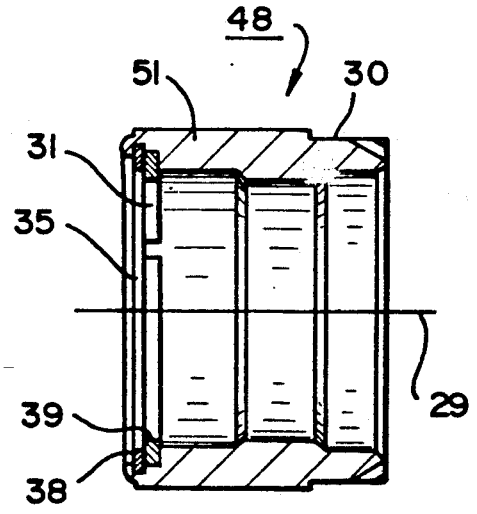
FIG. 5 is a cross sectional view of a nut and split ring/washer assembly for use with the connector of the preferred embodiment.

The third and final discrete element of the connector of the preferred embodiment is a coupling nut 30 shown in FIG. 4. This is the only element of the connector which is not generally cylindrical in shape. Instead, hexagonal surfaces may be included for facilitating coupling of the coupling nut to an externally threaded coupling nut on a female connector.

Coupling nut 30 is essentially conventional in configuration, including an internally threaded portion 30 for engaging a corresponding externally threaded portion on a second connector, except that first and second grooves 38 and 39 are provided in a mounting portion 51 for retaining washer 35 and split retaining ring 39. A corresponding groove 33 for the split retaining ring extends circumferentially around main body 56 of outer contact member 28.

Coupling nut 30 encapsulates a floating pre-stressed split ring and a flat retaining washer. This design eliminates costly installation tooling and labor by permitting the nut to simply be snapped into the outer contact groove 33 via the split ring, as follows:

Mounting portion 51 of coupling member 48 includes first and second grooves 38 and 39 respectively, groove 38 being deeper than groove 39 and in communication with groove 39 such that a step is formed between grooves 38 and 39. The deeper groove, groove 38, holds the washer and the shallower groove, groove 39, holds the split ring. The groove 38 may be formed by roll forming an edge of the nut to encapsulate both washer 35 and split ring 31 within the two grooves.

The inner diameter of washer 35 must be at least as large as the outer diameter of main body 56 of outer contact portion 28. Split ring 39, on the other hand, has an inner diameter which is less than the outer diameter of main body portion 56 and approximately equal to the diameter of groove 33 in the outer contact. The outer diameter of the washer is approximately equal to the diameter of groove 38, but the outer diameter of the split ring is less than the diameter of groove 39 to allow a ring expansion pocket to become dedicated.

Split ring 31 is resilient and expandable within groove 39 such that as nut 48 is inserted over outer contact member 28, the split ring expands to pass over main body 56 until it reaches groove 33. It is then free to return to its unstressed position and thus hold the nut on the outer contact. This facilitates either manual or automatic assembly of the connector, because special dedicated assembly tooling is not required in order to install the coupling nut and retaining ring on the connector.

It is noted that the split ring and washer configuration may be used with coupling members other than internally threaded nuts. For example, the split ring and washer could be used to mount a bayonet-type or externally threaded type coupling member to an outer contact having an external groove. Numerous other modifications will occur to those skilled in the art.

In order to assemble the connector of the preferred embodiment, the dielectric member 29 is first placed within recess 49 of cable connection module 24, or within recess 26 of outer contact member 28, and the outer contact is snapped over the retention shoulder 36 on the crimping member 24 which is press fit into recess 27 to retain the inner contact and dielectric in place and to locate the inner contact radially in respect to the outer contact tines 28. Nut 30 is then snapped over the outer contact so that split ring 39 resides in groove 33. At this time, assembly of the basic connector is complete.

In order to assemble the coaxial cable to the connector, a portion of core dielectric 42 is removed from the inner conductor, and jacket 43 and shield 41 are separated from the core dielectric. A crimping ferrule 25 is then placed over the outer jacket 43, inner conductor 40 is inserted into the bore in inner contact 32, and the shield and outer jacket are placed between module 24 and outer ferrule 25. Outer ferrule 25 is then crimped to secure the cable to the conductor.

It will of course be appreciated by those skilled in the art that the simplified assembly and alignment provided by the present invention will find application in connection with connectors other than N-type coaxial cable connectors. While the invention has been described specifically in the context of an N-type connector, it is intended that the invention not be limited thereto, but rather that it be limited only in accordance with the appended claims.

What is claimed is:

1. A connector for a cable having at least one inner conductor and an outer conductor which substantially surrounds said at least one inner conductor, comprising:

an inner contact including first connecting means for electrically connecting the inner conductor of said cable to the inner contact, and second connecting means for electrically connecting the inner contact to a corresponding contact on a second electrical connector;

an outer contact comprising an outer contact member including third connecting means for electrically connecting the outer contact to a corresponding contact on the second electrical connector;

a cable outer conductor connection module including fourth connecting means for electrically connecting the outer conductor of said cable to the connection module;

fifth connecting means for electrically connecting said connection module to said outer contact, said fifth connecting means comprising retaining means including a first recess in said outer contact and a portion integral with said outer contact member for positioning said connection module with respect to said outer contact, wherein said connection module is press fit into said first recess; and a coupling member rotatably mounted on said outer contact for securing said connector to a second connector, wherein said coupling member includes means for coupling said connector to a second connector, and a mounting portion, and said mounting portion comprises means defining a groove for encapsulating a washer and split ring, and wherein said nut defines a cylinder axis and said groove includes axially adjacent first and second grooves, said second groove being deeper than said first groove, an inner surface of said first groove thereby forming, together with a side surface of the second groove, a step, said washer being mounted in said second groove and said split ring being mounted in said first groove.

2. A connector as claimed in claim 1, wherein said outer contact portion includes a generally cylindrical main body portion comprising means including a circumferential groove for receiving said split ring, and said third connecting means comprises a cylindrical portion extending from said main body.

3. A connector as claimed in claim 2, wherein said washer is annular and includes an inner and an outer diameter, and wherein the diameter of said cylindrical main body portion is less than said inner diameter such that said washer fits over said main body portion, and wherein said split ring is resilient and also annular and includes a second inner and a second outer diameter, and wherein said second inner diameter is less than and said second outer diameter is greater than the diameter of said cylindrical main body portion such that, when said coupling member is inserted over said main body portion, said split ring expands against its resilience to fit over the cylindrical main body portion until it enters the circumferential groove, whereupon the split ring resumes its unstressed condition to retain the nut on the main body portion and yet permit rotation in respect thereto.

4. A connector as claimed in claim 3, wherein said outer contact main body portion further comprises means including a bevelled portion for expanding said split ring as it passes over said main body portion.

5. A snap-on nut and washer assembly, comprising:

a nut including an internally threaded portion and a mounting portion, said mounting portion comprising means defining axially adjacent grooves for encapsulating a washer and a split ring, said split ring retaining said washer in one of said grooves, wherein said nut defines a cylinder axis and said grooves include axially adjacent first and second grooves, said second groove being deeper than said first groove, an inner surface of said first groove thereby forming, together with a side surface of the second groove, a step, said washer being mounted in said second groove and said split ring being mounted in said first groove.

6. A connector comprising:

a contact assembly comprising means for electrically connecting a cable conductor to a second contact assembly; and a snap on nut and washer assembly including an internally threaded portion and a mounting portion, said mounting portion comprising means defining grooves for encapsulating a washer and a split ring, wherein said nut defines a cylinder axis and said grooves include axially adjacent first and second grooves, said second groove being deeper than said first groove and an inner surface of said first groove thereby forming, together with a side surface of the second groove, a step, said washer being mounted in said second groove and said split ring being mounted in said first groove.

7. A connector as claimed in claim 6, wherein said outer contact includes a generally cylindrical main body portion comprising means including a circumferential groove for receiving a split ring, and said means for electrically connecting said contact comprises a cylindrical contact portion extending from said main body.

8. A connector as claimed in claim 7, wherein said washer is annular and include an inner and an outer diameter, and wherein the diameter of said cylindrical main body portion is less than said inner diameter such that said washer fits over said main body portion, and wherein said split ring is resilient and also annular and includes a second inner and a second outer diameter, and wherein said second inner diameter is less than and said second outer diameter is greater than the diameter of said cylindrical main body portion such that, when said nut is inserted over said main body portion, said split ring expands against its resilience to fit over the cylindrical main body portion until it enters the circumferential groove, whereupon the split ring resumes its unstressed condition to retain the nut on the main body portion.

* * * * *

UNITED STATES PATENT AND TRADEMARK OFFICE

CERTIFICATE OF CORRECTION

PATENT NO. : 5,137,471

DATED : Aug. 11, 1992

INVENTOR(S) : Michael A. Verespej and Henry R. Fredlund

It is certified that error appears in the above-identified patent and that said Letters Patent is hereby corrected as shown below:

On the title page, item [75] Inventors: Michael A. Verespej, is shown residing in "Bridgewater". This should be corrected to show his city of residence as —BRIDGEPORT—.

Signed and Sealed this

Fourteenth Day of September, 1993

Bruce Lehman

*Attest:*

BRUCE LEHMAN

*Attesting Officer*

*Commissioner of Patents and Trademarks*